United States Patent [19]

Roman et al.

[11] Patent Number: 4,706,906

[45] Date of Patent: Nov. 17, 1987

[54] THREE-ARM HUB JOINT FOR TUBULAR STRUCTURES SPECIFICALLY FOR HOSE RACKS AND HOSE CARTS

[75] Inventors: Gianfranco Roman, Pasiano; Romeo Boraso, Corva di Azzano Decimo, both of Italy

[73] Assignee: Claber, S.p.A., Fiume Veneto, Italy

[21] Appl. No.: 860,828

[22] Filed: May 8, 1986

[30] Foreign Application Priority Data

Jun. 21, 1985 [IT] Italy ..... 22239/85 [U]

[51] Int. Cl.[4] ..... B65H 75/38

[52] U.S. Cl. ..... 242/86; 242/94; 403/175

[58] Field of Search ..... 403/175, 174, 178, 290, 403/170; 242/86, 86.2, 86.4, 94, 85

[56] References Cited

U.S. PATENT DOCUMENTS

| | | | |
|---|---|---|---|
| 2,118,396 | 5/1938 | Davis et al. | 403/290 X |
| 3,321,863 | 5/1967 | Maxam, Jr. | 403/290 X |
| 3,536,275 | 10/1970 | Salomon | 242/86 X |

FOREIGN PATENT DOCUMENTS

| | | | |
|---|---|---|---|
| 1108433 | 8/1955 | France | 403/175 |
| 1398919 | 6/1975 | United Kingdom | 242/86 |

*Primary Examiner*—Andrew V. Kundrat

*Attorney, Agent, or Firm*—Cushman, Darby & Cushman

[57] ABSTRACT

A single body of plastic material has three converging coplanar radial arms and a perpendicular central hole. Each arm has an axial seat with a blind bottom to receive one end of the tubular structure and means for locking said end. The central hole is designed to receive a rotation hub.

2 Claims, 4 Drawing Figures

THREE-ARM HUB JOINT FOR TUBULAR STRUCTURES SPECIFICALLY FOR HOSE RACKS AND HOSE CARTS

The present invention relates to a three-arm hub joint for tubular structures, specifically for hose racks and carts.

Hose racks and carts are known in which the revolving drum designed to receive the hose is supported by a metal tubular structure made in two parts connected by plastic joints which also support drum rotation hubs.

Known joints of the aforesaid type are formed of two equal bodies side by side each having a dead hole seat to receive one end of a structural tubular part and a perpendicular through half-seat which operates in conjunction with the corresponding half-seat of the other body of the joint to receive the drum hub.

A drawback of the abovedescribed joints is the two-piece design thereof which makes necessary a certain amount of time and care in assembling.

Another drawback is the fact that they allow connection of only two parts of the tubular structure which in the case of hose racks and carts must consequently assume different forms which give rise to problems of encumbrance and hence storage and shipping difficulties.

The purpose of the present invention is to accomplish a hub joint of extremely simple structure and assembly which would solve present storage and shipping problems.

In accordance with the invention said object is achieved by a hub joint characterized in that it consists of a single body with three coplanar radial arms converging in a single centre each of said arms having an axial seat with a blind bottom designed to receive one end of a respective tubular structural part and said body being traversed by a central hole perpendicular to said arms designed to receive a rotation hub.

This is a hub of extremely simple construction which is readily and rapidly applicable for the joining of tubular structural parts and support of a rotation hub such as that of a hose rack or cart.

The hub joint in accordance with the invention also allows joining of three tubular structural parts which consequently can be made in the same form, one for front support, another for rear support, and the last for grasping and handling. This drastically reduces present storage and shipping difficulties.

Figure 1:
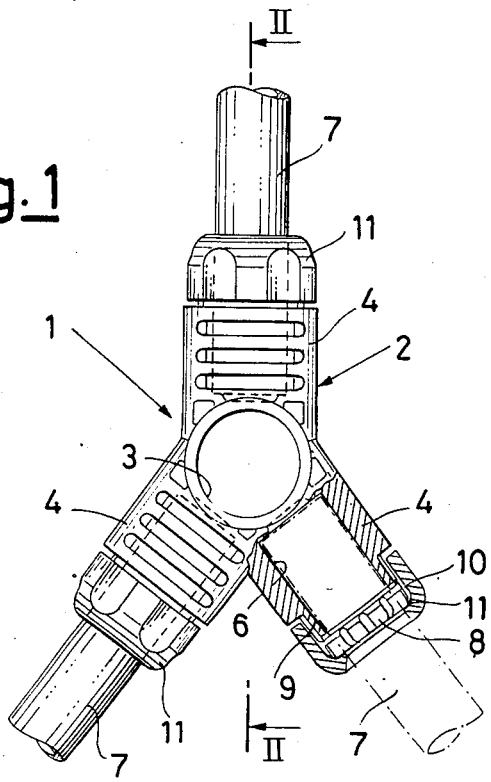
Figure 2:
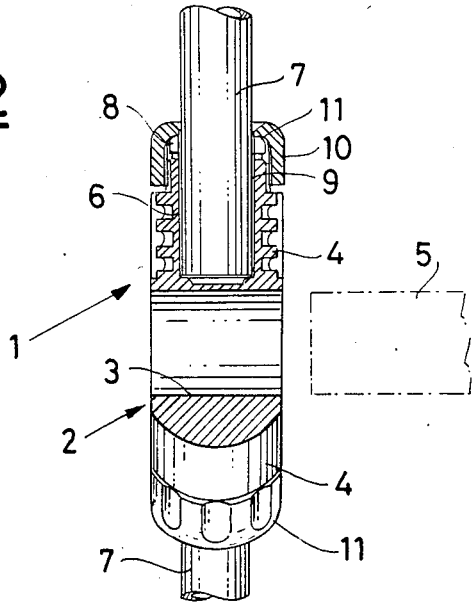
Figure 3:
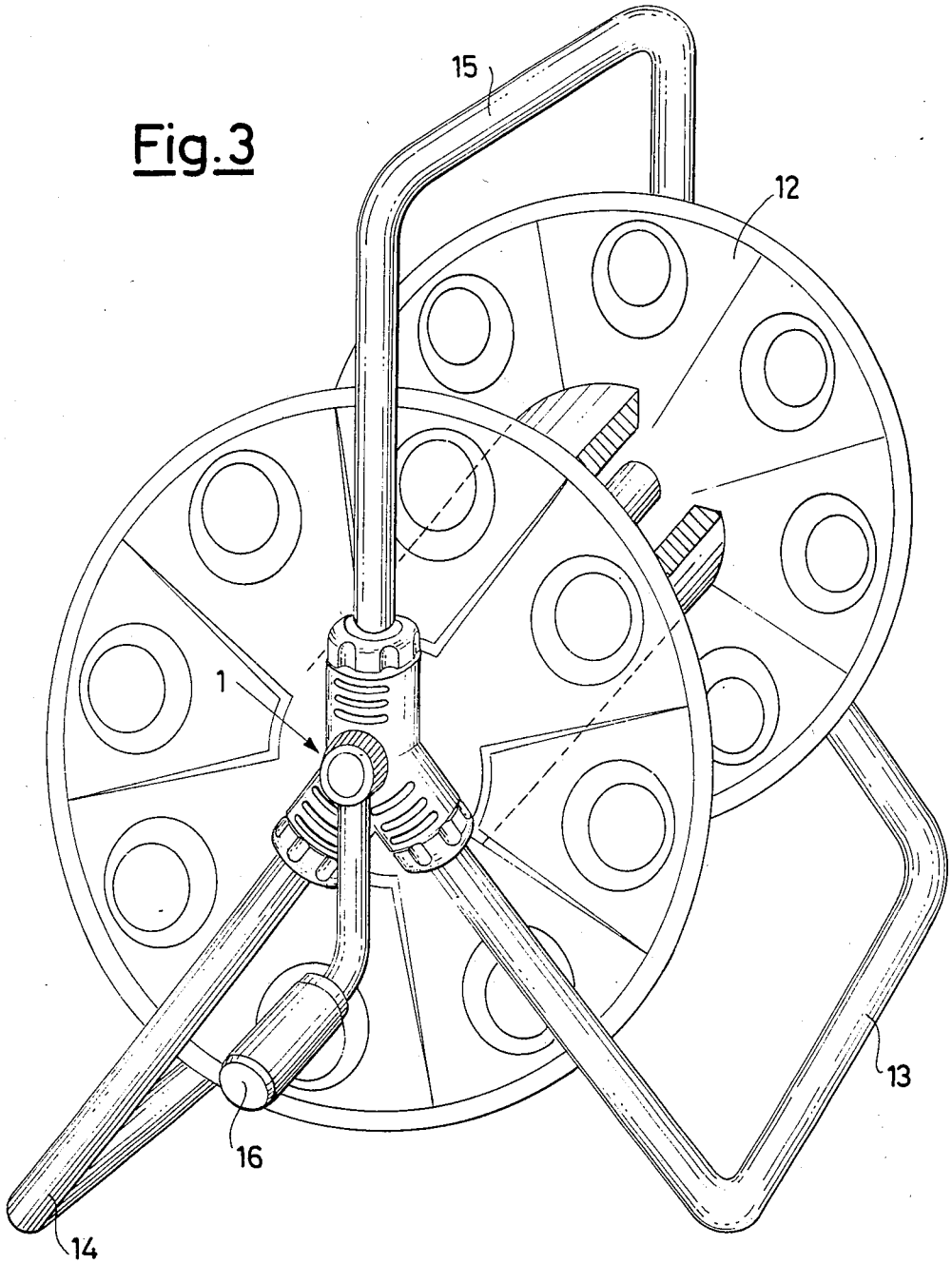
Figure 4:
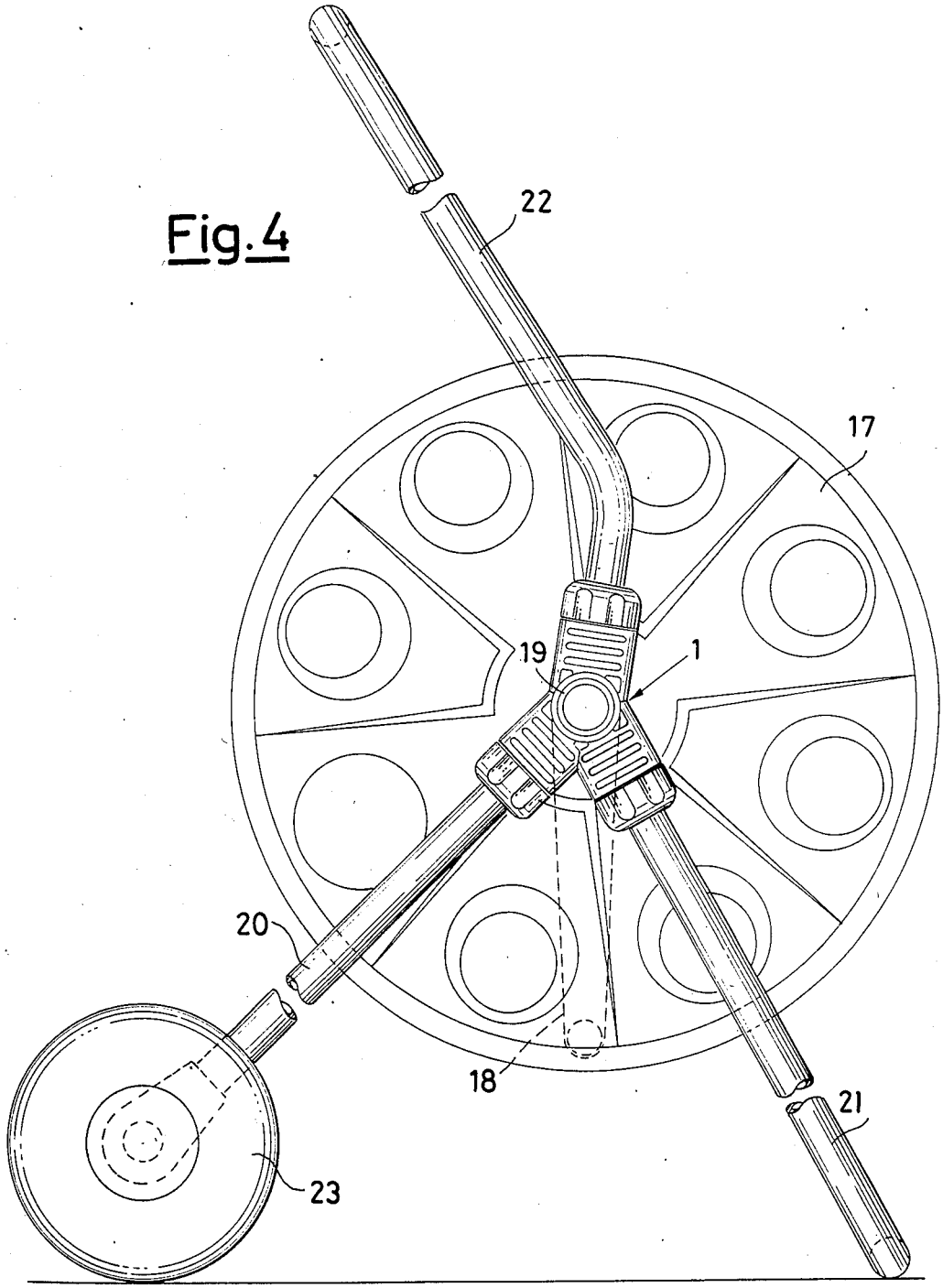

An example of a practical embodiment of the hub joint in accordance with the invention is illustrated for greater clarity in the annexed drawings wherein:

FIG. 1 shows a partially cutaway front view of a hub joint in accordance with the invention, FIG. 2 shows a sectional view of said joint along plane of cut II—II of FIG. 1, and FIGS. 3 and 4 show examples of the use of the hub joint of FIGS. 1 and 2 in a hose rack and in a hose cart respectively.

With reference to FIGS. 1 and 2 a hub joint 1 is shown which consists of a single plastic body 2 having a through central hole 3 and three arms 4 extending radially from said hole. The axes of the arms 4 describe a common plane perpendicular to the axis of the hole 3.

The central hole 3 is designed to receive a rotation hub as sketched in broken lines and indicated with reference number 5 in FIG. 2 such as that of the rotating drum of a hose rack or cart.

The radial arms 4 are in turn provided with cylindrical axial seats with blind bottoms 6 in which are receivable and lockable the respective ends 7 of connectable tubular structures.

To lock said ends the radial arms 4 have elastic tabs 8 distributed around their circumferences and projecting from threaded tangs 9 on which may be screwed ring nuts 10 having converging surfaces 11 capable of forcing the flexible tabs 8 inward in gripping engagement with the tubular elements 7. This locking system is known per se and will therefore not be described more thoroughly herein.

The hub joint shown in FIGS. 1 and 2 lends itself particularly well to use in a hose rack such as the one shown in FIG. 3 which is designed for garden watering.

Said hose rack comprises a revolving hose drum 12 and a tubular supporting structure formed of a front supporting part 13, a rear supporting part 14 or two side supporting parts if preferred and a top part 15 for grasping and handling.

The three tubular structural parts 13, 14 and 15 have identical U shapes making them interchangeable.

Two hub joints 1 are used at the two sides of the revolving drum 12 to join together the free ends of the three tubular structural parts 13, 14 and 15 and act as supports for the end hubs of the drum 12. An operating crank is applied to one of the aforesaid hubs.

The hub joint shown in FIGS. 1 and 2 can also be used in a hose cart such as the one shown in FIG. 4 intended for similar gardening purposes.

In this case two hub joints 1 placed at the two sides of a revolving hose-drum 17 fitted with an operating crank 18 are used to support the end hubs 19 of the drum 17 and to connect together the three metallic tubular structural supporting parts 20, 21 and 22 one of which (20) is fitted with wheels 23. The two lower ones 20 and 21 are exactly alike with a U shape while the third part 22 can have a like or a different shape.

We claim:

1. A hub joint for tubular structures, specifically for hose racks and carts comprising:

a single body with three coplanar radial arms converging in a single center, each of said arms having an axial seat with a blind bottom to receive one end of a respective tubular structural part and said body being traversed by a central hole perpendicular to said arms for receiving a rotation hub; and wherein each of said arms is fitted with locking tabs projecting from threaded tangs on which may be screwed ring nuts having converging surfaces capable of forcing said locking tabs in gripping engagement with their respective tubular structural part.

2. A hose rack comprising:

a hose drum upon which a hose may be wound, said drum having a rotation hub;

a hub joint including a single body with three coplanar radial arms converging in a single center, said joint being connected to said drum, each of said arms having an axial seat with a blind bottom to receive one end of one of three U-shaped tubular structural parts, said body being traversed by a central hole perpendicular to said arms for receiving said rotation hub, wherein each of said arms is fitted with locking tabs projecting from threaded tangs on which may be screwed cylindrical ring nuts, said nuts being located at the ends of said arms and having converging surfaces capable of forcing said locking tabs in gripping engagement with their respective tubular structural part; and a crank for winding and unwinding the hose.

* * * * *